US009065211B2

(12) United States Patent
Shimizu et al.

(10) Patent No.: US 9,065,211 B2
(45) Date of Patent: Jun. 23, 2015

(54) LEVER-TYPE CONNECTOR

(75) Inventors: Tomohiko Shimizu, Shizuoka (JP); Akinori Tashiro, Shizuoka (JP); Akihiro Tsuruta, Shizuoka (JP); Kazuya Terao, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/129,573

(22) PCT Filed: Jun. 28, 2012

(86) PCT No.: PCT/JP2012/066522

§ 371 (c)(1), (2), (4) Date: Mar. 26, 2014

(87) PCT Pub. No.: WO2013/005630

PCT Pub. Date: Jan. 10, 2013

(65) Prior Publication Data

US 2014/0235081 A1 Aug. 21, 2014

(30) Foreign Application Priority Data

Jul. 1, 2011 (JP) ..... P2011-147260

(51) Int. Cl.

*H01R 13/629* (2006.01)
*H01R 13/64* (2006.01)
*H01R 13/74* (2006.01)

(52) U.S. Cl.

CPC .... *H01R 13/62938* (2013.01); *H01R 13/62933* (2013.01); *H01R 13/64* (2013.01); *H01R 13/74* (2013.01)

(58) Field of Classification Search

CPC ..... H01R 13/62938; H01R 13/62933; H01R 13/62977; H01R 13/741; H01R 13/64; H01R 13/74

See application file for complete search history.

(56) References Cited

U.S. PATENT DOCUMENTS 5,954,528 A * 9/1999 Ono et al. ..... 439/157
7,637,757 B2 * 12/2009 Matsumura et al. ..... 439/157

(Continued)

FOREIGN PATENT DOCUMENTS

JP 2002-359035 A 12/2002
JP 2002-359037 A 12/2002

OTHER PUBLICATIONS

Korean office action letter issued on Apr. 2, 2015 in the counterpart Korean patent application.

*Primary Examiner* — Edwin A. Leon
(74) *Attorney, Agent, or Firm* — Marvin A. Motsenbocker; Mots Law, PLLC

(57) ABSTRACT

This lever-type connector (1) having: a first connector (11); a second connector (21); and a lever (31) that fits the connectors (11, 21) together by being rotated. The first connector (11) has an engagement lock part (14) that is inserted through an attachment hole (52) by being bent and deformed toward the inner surface side at the time of attaching the first connector to the attachment hole (52). The lever (31) has an arm part (32) that is located on the inner surface side of the first connector (11) during the rotation of the lever (31). The arm part (32) has: a deformation permitting part (37) that permits the bending deformation thereof when the lever (31) is at a rotation position where the connectors (11, 21) are in a half-fitted state; and a deformation preventing part (36) that prevents the bending deformation thereof.

4 Claims, 8 Drawing Sheets

(56) References Cited

U.S. PATENT DOCUMENTS

2002/0182928 A1 12/2002 Matsushita
2004/0077197 A1* 4/2004 Nishide ..... 439/157
2007/0293080 A1* 12/2007 Miyamoto ..... 439/352
2008/0248664 A1* 10/2008 Shibata ..... 439/157

* cited by examiner (a)

(b)

(a)

(b)

LEVER-TYPE CONNECTOR

TECHNICAL FIELD

The present invention relates to a lever-type connector to be attached to a panel.

BACKGROUND ART

A conventional lever-type connector to be attached to a panel includes: a first connector; a second connector fittable to the first connector; and a lever provided on the first connector and configured to be turned to fit the first connector and the second connector to each other. Here, the first connector and the second connector in a fitted state are attached to an attachment hole in a panel (Japanese Patent Application Laid-open Publication No. 2002-359037).

In this lever-type connector, the lever is provided with an interference portion in order to prevent the connectors in an incompletely fitted state from being attached to the panel. The interference portion does not interfere with a hole edge of the attachment hole in the panel when the connectors are in a completely fitted state. The interference portion interferes with the hole edge of the attachment hole when the connectors are in the incompletely fitted state.

Accordingly, in the process of attaching the connectors to the attachment hole in the panel, it is possible to detect a fitted state of the connectors based on whether or not the interference portion interferes with the hole edge of the attachment hole.

When the connectors are fitted into the attachment hole in the state where the interference portion does not interfere with the hole edge of the attachment hole (the state where the connectors are properly fitted to each other), an elastic retaining piece formed on the interference portion is inserted through the attachment hole and locks the hole edge of the attachment hole from the back side. Thus, the connectors are attached to the panel.

CITATION LIST

Patent Literature

[PTL 1] Japanese Patent Application Laid-open Publication No. 2002-359037

SUMMARY OF INVENTION

Technical Problem

In the above-described lever-type connector, the connectors transition from the incompletely fitted state to the completely fitted state depending on the turning angle of the lever. For this reason, when the tuning angle of the lever is close to the angle corresponding to the completely fitted state, the interference by the interference portion with the hole edge of the attachment hole is so small that the connectors may be fitted into the attachment hole in spite of the incompletely fitted state. In such a case, it is difficult to detect that the connectors are in the incompletely fitted state.

Meanwhile, the elastic retaining piece is designed to be elastically deformed by the hole edge of the attachment hole when the lever-type connector is fitted into the attachment hole. For this reason, if the elastic retaining piece is elastically deformed by an external force after the connectors are attached to the attachment hole in the panel, the connectors may come off the attachment hole.

In view of the above, it is an object of the present invention to provide a lever-type connector capable of solving the existing challenge to prevent the connectors in an incompletely fitted state from being attached to a panel, and also preventing the connectors from coming off the panel.

Solution to Problem

For the purpose of achieving the foregoing object, a lever-type connector according to a first aspect of the present invention includes: a first connector; a second connector fittable to the first connector; and a lever provided on any one of the first connector and the second connector, and configured to be turned to fit the first connector and the second connector to each other. The first connector and the second connector in a fitted state are attached to an attachment hole in a panel. The one connector includes a lock portion designed to be flexurally deformed toward its inner surface side and inserted through the attachment hole in the course of attaching the connectors to the attachment hole. The lever includes: an arm portion located on the inner surface side of the one connector while the lever is being turned; and a panel contact part configured to turn the lever by coming into contact with a hole edge of the attachment hole in a state where the lock portion is inserted through the attachment hole. The arm portion includes: a deformation allowing part designed to allow flexural deformation of the lock portion by being located on an inner surface side of the lock portion when the lever is situated in a turning position to bring the first connector and the second connector into an incompletely fitted state; and a deformation blocking part designed to block the flexural deformation of the lock portion by being located on the inner surface side of the lock portion when the lever is situated in a turning position to bring the first connector and the second connector into a completely fitted state. The lever is turned to the turning position to bring the first connector and the second connector into the completely fitted state by pressing the panel contact part against the hole edge while keeping the panel contact part in contact with the hole edge.

In the lever-type connector, the deformation allowing part may include a recessed groove portion provided in a surface of the arm portion, and the deformation blocking part may include the surface of the arm portion excluding the recessed groove portion.

Furthermore, in the lever-type connector, the lever further includes an operating portion configured to perform a turning operation of the lever, and the lever is turned by the turning operation of the operating portion, or by pressing the panel contact part against the hole edge while keeping the panel contact part in contact with the hole edge.

Advantageous Effects of Invention

According to the lever-type connector of the first aspect of the present invention, when the connectors are in the incompletely fitted state, the deformation allowing part is located on the inner surface side of the lock portion. Thus, the flexural deformation of the lock portion is allowed and the connectors can be attached to the attachment hole in a panel.

On the other hand, when the connectors are brought into the completely fitted state by pressing the panel contact part against the hole edge while keeping the panel contact part in contact with the hole edge, the deformation blocking part is located on the inner surface side of the lock portion. Thus, the flexural deformation of the lock portion is blocked and the completely fitted connectors can be prevented from coming off the attachment hole in the panel.

Meanwhile, the lever is turned to the turning position to bring the connectors into the completely fitted state by pressing the panel contact part against the hole edge while keeping the panel contact part in contact with the hole edge. Accordingly, it is possible to reliably prevent the connectors in the incompletely fitted state from being attached to the panel.

Thus, it is possible to provide the lever-type connector capable of preventing the connectors in the incompletely fitted state from being attached to the panel, and preventing the connectors from coming off the panel.

According to the lever-type connector, the deformation allowing part may include the recessed groove provided in the surface of the arm portion while the deformation blocking part may include the surface of the arm portion excluding the recessed groove. Thus, the flexural deformation of the lock portion can be blocked or allowed by using the simple structures.

Meanwhile, according to the lever-type connector, the connectors can be brought into the completely fitted state by: bringing the connectors into the incompletely fitted state by using the operating portion; and then pressing the panel contact part against the hole edge while keeping the panel contact part in contact with the hole edge. Thus, a fitting operation of the connectors can be easily achieved.

DESCRIPTION OF EMBODIMENTS

Figure 1:
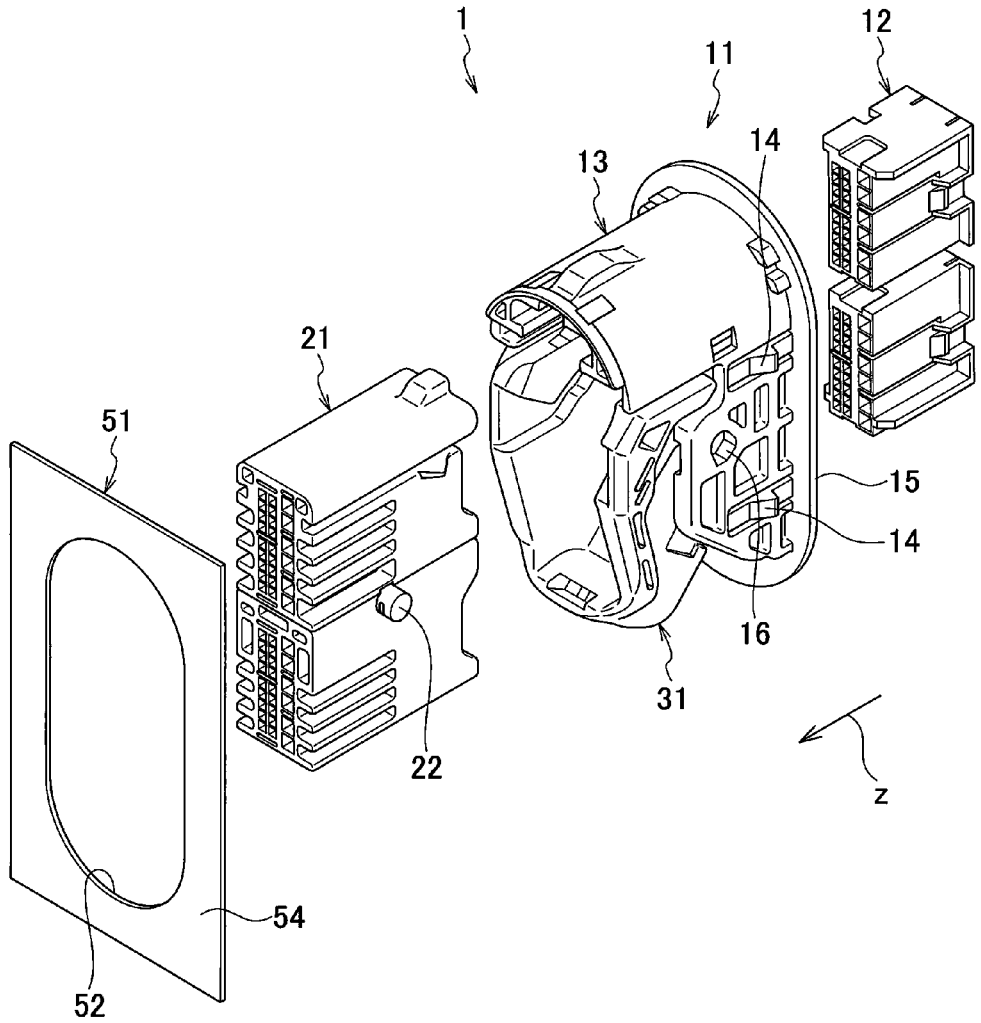
FIG. 1 is an exploded perspective view of a lever-type connector according to an embodiment of the present invention.
Figure 2:
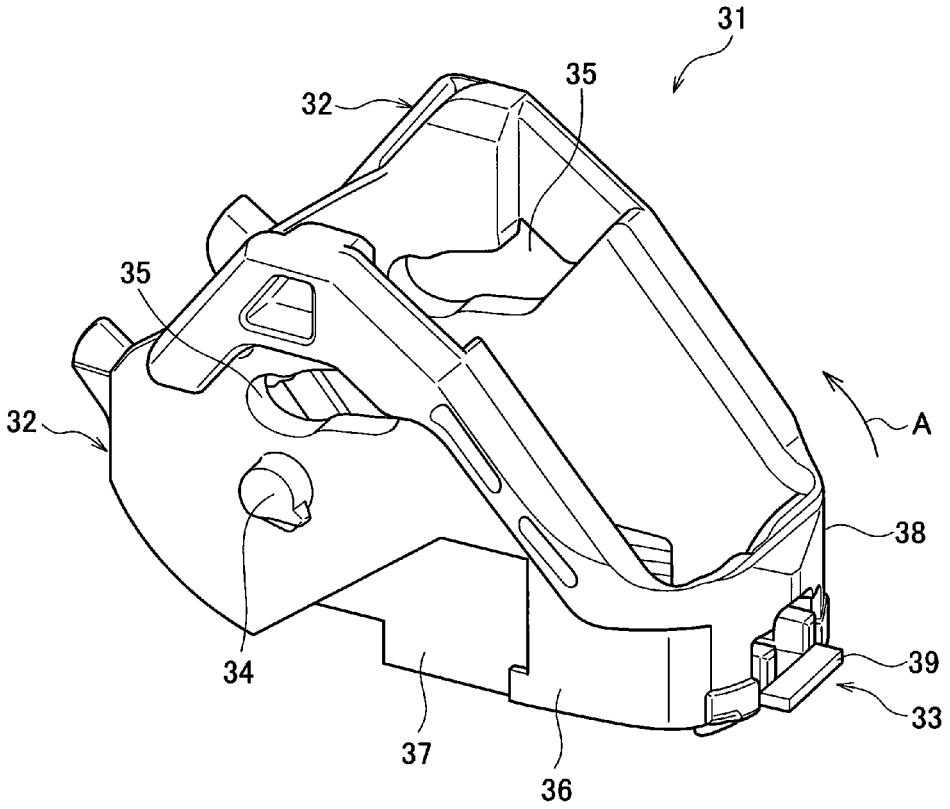
FIG. 2 is a perspective view showing a lever according to the embodiment of the present invention.

An embodiment of the present invention will be described below with reference to the drawings. First, a configuration of a lever-type connector according to the embodiment of the present invention will be described in detail with reference to FIG. 1 and FIG. 2. FIG. 1 is an exploded perspective view of the lever-type connector according to the embodiment of the present invention. FIG. 2 is a perspective view showing a lever according to the embodiment of the present invention.

The lever-type connector according to the embodiment of the present invention relates to an LIF (low insertion force) connector which causes male and female connectors (a first connector and a second connector to be described later), each including multiple terminal tags, to be fitted to each other with a low insertion force.

As shown in FIG. 1, a lever-type connector 1 according to the embodiment of the present invention mainly includes: a first connector 11; a second connector 21 fittable to the first connector 11; and a lever 31 provided on the first connector 11 and configured to be turned to fit the first connector 11 and the second connector 21 to each other.

Further, with the first connector 11 and the second connector 21 incompletely fitted to each other, the lever-type connector 1 configured as described above is fitted into an attachment hole 52 formed in a panel 51 to be described later.

After the first connector 11 and the second connector 21 are fitted into the attachment hole 52 to be described later, the connectors 11 and 21 are brought into a completely fitted state by turning the lever 31 while pressing the lever-type connector 1 against the later-described panel 51. Thus, the connectors 11 and 21 are attached to the panel 51.

The first connector 11 (the female connector) includes: an inner housing 12 configured to house female terminal tags (not shown) provided on a cable terminal; and a frame 13 configured to enclose the inner housing 12.

The inner housing 12 has a structure in which two housing components are vertically superposed. The multiple female terminal tags (not shown) are housed inside the inner housing 12. The inner housing 12 is enclosed in the frame 13.

The frame 13 includes: multiple (four in the embodiment of the present invention) lock portions 14 which are flexurally deformably provided; a flange portion 15 provided on the outer periphery of the frame 13; and a pair of rotating shaft holes 16 (one of which is not shown), into which rotating shaft pins 34 (see FIG. 2) of the lever 31 to be described later are inserted.

Each of the multiple lock portions 14 includes: a lock projecting part 17 which projects to the outside of the first connector 11 (for example, a side in an arrow X direction in FIG. 4 to be described later); and a lock contact part 18 provided on the inside of the first connector 11 (for example, a side in an arrow Y direction in FIG. 4 to be described later) and contactable with the lever 31 (see FIG. 4 to be described later).

In addition, when the multiple lock portions 14 configured as described above are attached to the attachment hole 52 in the panel 51 to be described later, each of the lock portions 14 is inserted through the attachment hole 52 to be described later while being flexurally deformed toward an inner surface side of the first connector 11 (for example, the side in the arrow Y direction in FIG. 4 to be described later).

When the first connector 11 and the second connector 21 in the incompletely fitted state are pressed toward a front face side of the panel 51 (a side in an arrow Z direction in FIG. 1 and FIG. 4 to be described later), the lock projecting parts 17 come into contact with the later-described panel 51 from its rear face side 54 (see FIG. 1), and thereby fix the connectors 11 and 21 to the panel 51 (see FIG. 4 to be described later).

The lock contact parts 18 come into contact with deformation blocking parts 36 (see FIG. 2) of the lever 31 to be described later, thereby blocking the flexural deformation of the lock portions 14. In addition, when the lock contact parts 18 come out of contact with the lever 31 with the assistance of deformation allowing parts 37 (see FIG. 2) of the lever 31 to be described later, the lock contact parts 18 allow the flexural deformation of the lock portions 14 (see FIG. 5 and FIG. 8 to be described later).

When the first connector 11 and the second connector 21 in the completely fitted state are attached to the attachment hole 52 in the panel 51, the flange portion 15 comes into contact with a hole edge 53 from the front face side (the side in the arrow Z direction in FIG. 1 and FIG. 4 to be described later) of the panel 51 to be described later (see FIG. 6(*b*) to be described later).

The pair of rotating shaft pins 34 (see FIG. 2) provided on the lever 31 to be described later are respectively inserted into the pair of rotating shaft holes 16 from an inner wall side of the first connector 11. As a consequence of the insertion of the rotating shaft pins 34 into the rotating shaft holes 16, the lever 31 is rotatably attached to the first connector 11 (the frame 13).

The second connector 21 has a structure in which two housing components larger than the inner housing 12 are vertically superposed. The multiple male terminal tags (not shown) are housed inside the second connector 21. When the first connector 11 and the second connector 21 are brought into the completely fitted state, the male terminal tags are connected to the female terminal tags (not shown) housed inside the inner housing 12.

Meanwhile, cam followers 22 (one of which is not shown) to be inserted into cam grooves 35 (see FIG. 2) of the lever 31 to be described later are respectively provided in a projecting manner on two side surfaces of the second connector 21. By inserting the cam followers 22 into the cam grooves 35 and then turning the lever 31, the second connector 21 is drawn into the first connector 11.

As shown in FIG. 2, the lever 31 includes: a pair of arm portions 32, each of which is located on the inner surface side (for example, the side in the arrow X direction in FIG. 4 to be described later) of the first connector 11 (see FIG. 1) when the lever 31 is turned; and a connecting portion 33 that connects the pair of arm portions 32.

The pair of arm portions 32 include: the pair of rotating shaft pins 34 (one of which is not shown) to be inserted into the rotating shaft holes 16 (see FIG. 1) of the frame 13; the pair of cam grooves 35 into which the cam followers 22 (see FIG. 1) of the second connector 21 are inserted; the deformation blocking parts 36 which block the flexural deformation of the lock portions 14 of the frame 13; and the deformation allowing parts 37 which allow the flexural deformation of the lock portions 14.

The pair of rotating shaft pins 34 are inserted into the rotating shaft holes 16 (see FIG. 1) from the inner wall side of the first connector 11. Thus, the lever 31 is rotatably attached to the first connector 11 (the frame 13).

The cam grooves 35 are respectively formed on the pair of arm portions 32. When the lever 31 is turned with the cam followers 22 (see FIG. 1) inserted in the cam grooves 35, the distance between each cam follower 22 and the corresponding rotating shaft pin 34 is changed whereby the second connector 21 moves toward the first connector 11 (see FIG. 1).

The deformation blocking parts 36 are formed from the surfaces of the arm portions 32 excluding the recessed grooves (the deformation allowing parts 37) formed in those surfaces. Each of the deformation blocking parts 36 is located on the inner surface side of the corresponding lock portion 14 (for example, the side in the arrow Y direction in FIG. 4 to be described later) when the lever 31 is situated in a turning position to bring the first connector 11 and the second connector 21 into the completely fitted state. Thus, the deformation blocking parts 36 block the flexural deformation of the lock portions 14 (see FIG. 4 and FIG. 5 to be described later).

In other words, when each of the deformation blocking parts 36 is located on the inner surface side of the corresponding lock portion 14 (for example, the side in the arrow Y direction in FIG. 4 to be described later), the deformation blocking part 36 is in contact with the lock contact part 18 of the corresponding lock portion 14 and blocks the flexural deformation of the lock portion 14.

Each of the deformation allowing parts 37 is formed from the recessed groove provided in the surface of the corresponding arm portion 32. Each deformation allowing part 37 is located on the inner surface side of the corresponding lock portion 14 when the lever 31 is situated in a turning position to bring the first connector 11 and the second connector 21 into the incompletely fitted state. Thus, the deformation allowing parts 37 allow the flexural deformation of the lock portions 14 (see FIG. 7 and FIG. 8 to be described later).

In other words, when each of the deformation allowing parts 37 is located on the inner surface side of the corresponding lock portion 14 (for example, the side in the arrow Y direction in FIG. 4 to be described later), the lock contact part 18 of the lock portion 14 is out of contact with the corresponding arm portion 32 of the lever 31. Thus, the deformation allowing parts 37 allow the flexural deformation of the lock portions 14.

As described above, the deformation allowing parts 37 are formed from the recessed grooves provided in the surfaces of the arm portions 32, while the deformation blocking parts 36 are formed from the surfaces of the arm portions 32 excluding the recessed grooves. As a consequence, the flexural deformation of the lock portions 14 can be blocked or allowed by using the simple structures.

When the lever 31 is situated in the turning position to bring the first connector 11 and the second connector 21 into the incompletely fitted state (for example, a position of the lever 31 shown in FIG. 3 to FIG. 5), each of the above-described arm portions 32 is displaced in response to the turn of the lever 31 in such a way as to locate the corresponding deformation allowing part 37 on the inner surface side of the corresponding lock portion 14 (for example, the side in the arrow Y direction in FIG. 4 to be described later).

In the meantime, when the lever 31 is situated in the turning position to bring the first connector 11 and the second connector 21 into the completely fitted state (for example, the position of the lever 31 shown in FIG. 6 to FIG. 8), each of the arm portions 32 is displaced in response to the turn of the lever 31 in such a way as to locate the corresponding deformation blocking part 36 on the inner surface side of the corresponding lock portion 14 (for example, the side in the arrow Y direction in FIG. 4 to be described later).

Hence, each of the arm portions 32 is provided with the deformation blocking part 36 and the deformation allowing part 37 corresponding to the turning angles of the lever 31 in such a way that either one of the deformation blocking part 36 and the deformation allowing part 37 is located on the inner surface side of the corresponding lock portion 14 (for example, the side in the arrow Y direction in FIG. 4 to be described later) depending on the turning position of the lever 31.

The connecting portion 33 includes: an operating portion 38 which is subjected to a tuning operation when the lever 31 is turned to bring the first connector 11 and the second connector 21 into the incompletely fitted state; and a panel contact part 39 configured to turn the lever 31 by causing the lock portions 14, which are in the state of being inserted through the attachment hole 52 in the panel 51 to be described later, to come into contact with the hole edge 53 of the attachment hole 51 to be described later.

The panel 51 is provided with: the attachment hole 52 having a vertical ellipsoidal shape and allowing the insertion of the lock portions 14; the hole edge 53 with which the flange portion 15 is contactable; and the rear surface side 54 with which the lock projecting parts 17 are contactable (see FIG. 1).

When the lever 31 is turned by operating the operating portion 38 in an arrow A direction in FIG. 2, the connecting portion 33 is displaced along an arc around the rotating shaft pins 34 (the rotation center).

The panel contact part 39 is formed into a plate shape and provided to protrude outward from the lever 31. When the panel contact part 39 is pressed against the hole edge 53 while keeping the panel contact part 39 in contact with the hole edge 53 of the panel 51, the panel contact part 39 turns the lever 31, thereby bringing the first connector 11 and the second connector 21, being brought into the incompletely fitted state by using the operating portion 38, further into the completely fitted state.

Thus, it is possible to establish the completely fitted state of the connectors 11 and 21 by: bringing the connectors 11 and 21 into the incompletely fitted state by using the operating portion 38; and then pressing the panel contact part 39 against the hole edge 53 while keeping the panel contact part 39 in contact with the hole edge 53. Hence, a fitting operation of the connectors 11 and 21 can be achieved easily.

In addition, since the connectors 11 and 21 are brought into the completely fitted state by pressing the panel contact part 39 against the hole edge 53 while keeping the panel contact part 39 in contact with the hole edge 53, it is possible to reliably prevent the connectors 11 and 21 in the incompletely fitted state from being attached to the panel 51.

Moreover, the above-described first connector 11 and second connector 21 in the incompletely fitted state are fitted into the attachment hole 52 in the panel 51. Then, the lever 31 is pressed against the panel 51 and the connectors 11 and 21 in the completely fitted state are thus attached to the panel 51 (see FIG. 3 to FIG. 8 to be described later).

Figure 3:
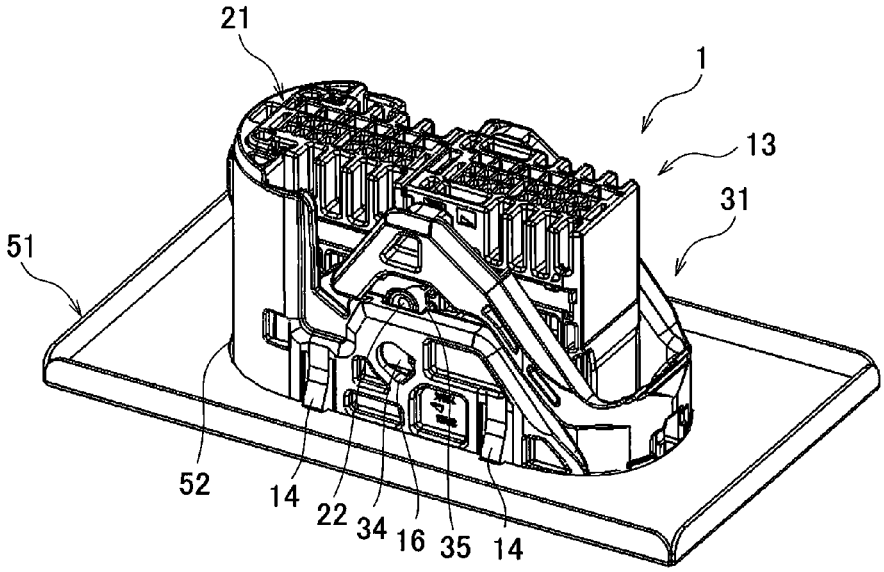
FIG. 3 depicts a perspective view and a cross-sectional view showing connectors according to the embodiment of the present invention, which are in an incompletely fitted state.
Figure 3:
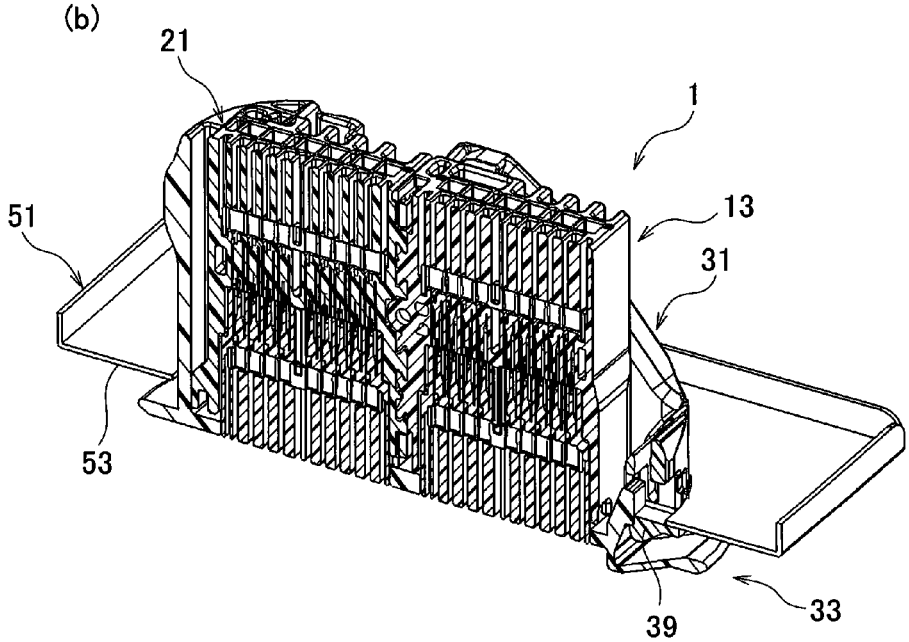

Next, the fitting operation of the lever-type connector according to the embodiment of the present invention will be described with reference to FIG. 3 to FIG. 8. FIG. 3(*a*) is a perspective view showing the connectors according to the embodiment of the present invention, which are in the incompletely fitted state. FIG. 3 (*b*) is a cross-sectional view corresponding to FIG. 3(*a*).

Figure 4:
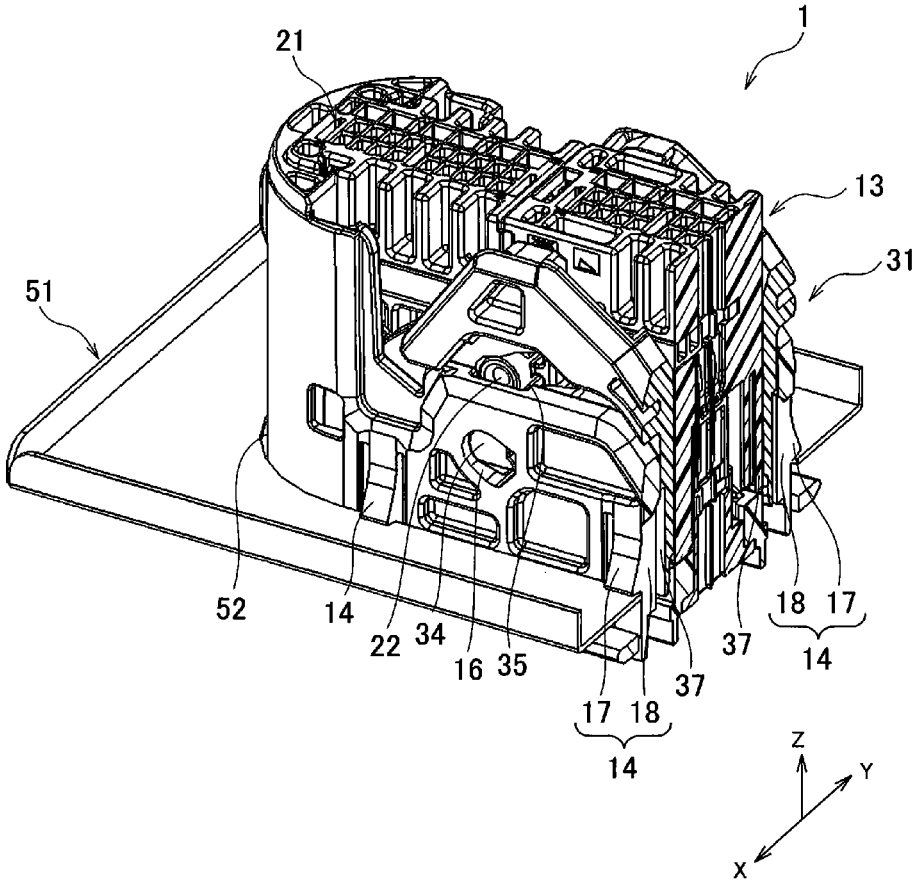
FIG. 4 is a cross-sectional view showing relations between lock portions and arm portions when the connectors according to the embodiment of the present invention are in the incompletely fitted state.
Figure 5:
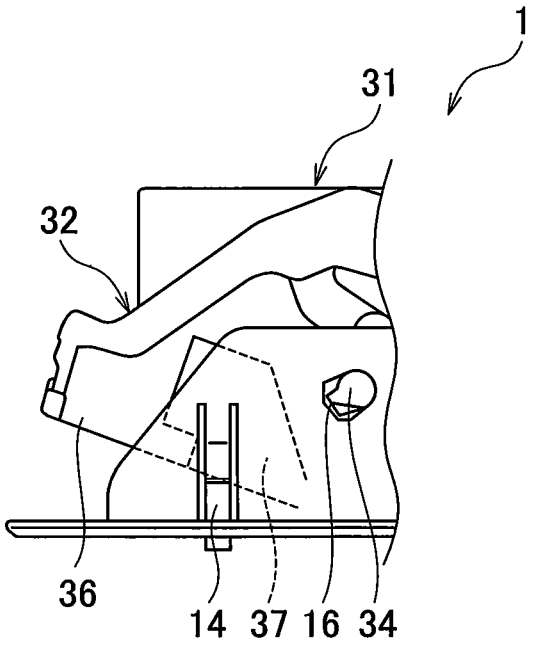
FIG. 5 is a side view showing a position of a deformation allowing part when the connectors according to the embodiment of the present invention are in the incompletely fitted state.

Meanwhile, FIG. 4 is a cross-sectional view showing relations between the lock portions and the arm portions when the connectors according to the embodiment of the present invention are in the incompletely fitted state. FIG. 5 is a side view showing a position of a deformation allowing part when the connectors according to the embodiment of the present invention are in the incompletely fitted state.

Figure 6:
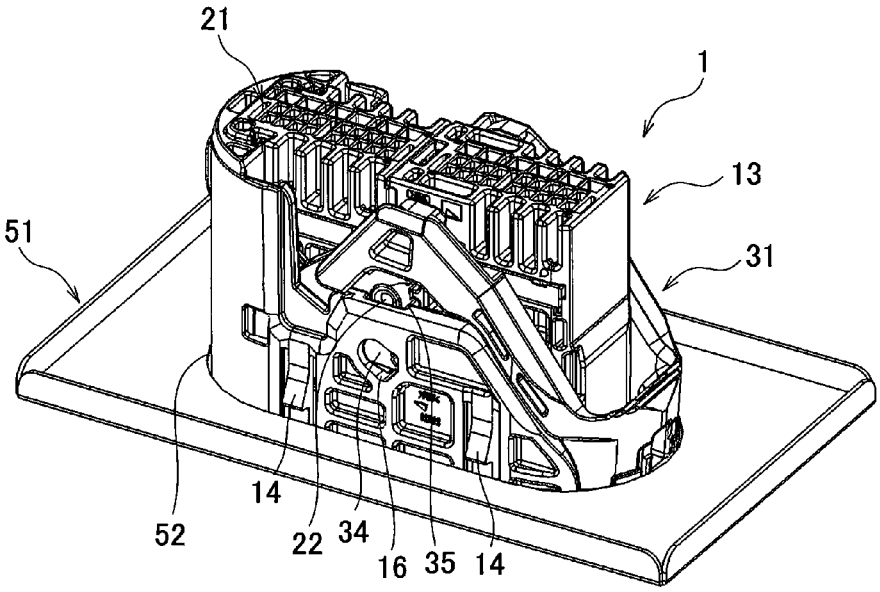
FIG. 6 depicts a perspective view and a cross-sectional view showing the connectors according to the embodiment of the present invention, which are in a completely fitted state.
Figure 6:
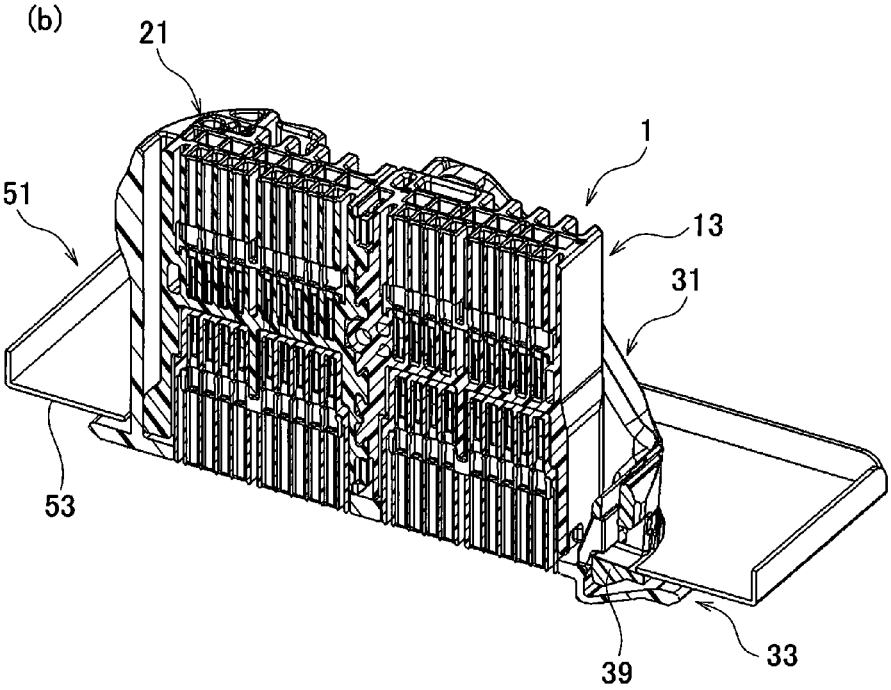
Figure 7:
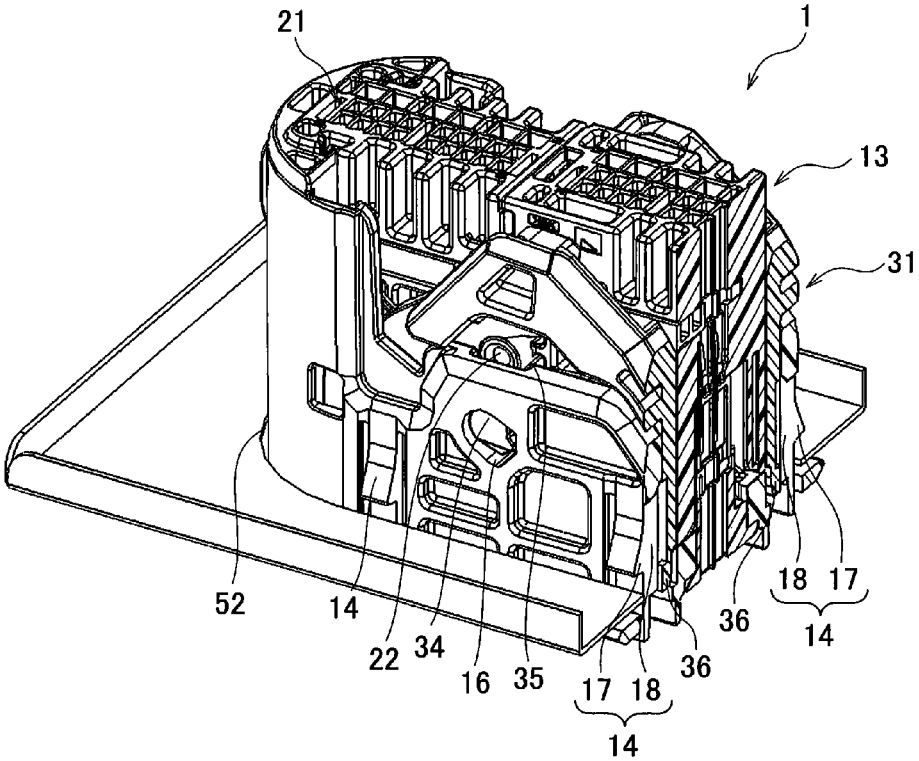
FIG. 7 is a cross-sectional view showing relations between the lock portions and the arm portions when the connectors according to the embodiment of the present invention are in the completely fitted state.
Figure 8:
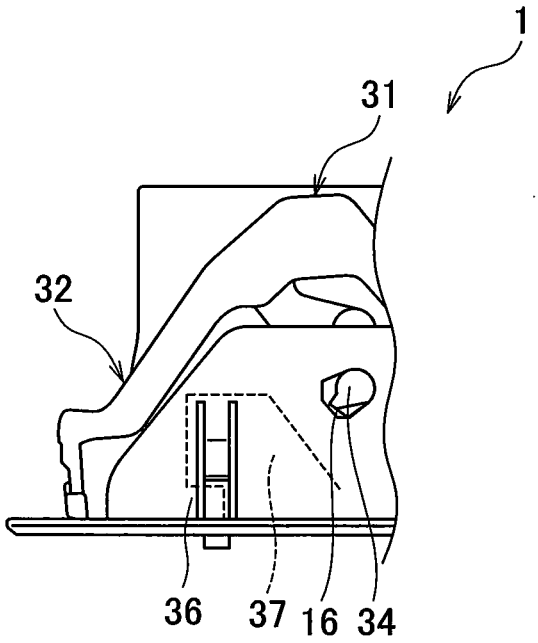
FIG. 8 is a side view showing a position of a deformation blocking part when the connectors according to the embodiment of the present invention are in the completely fitted state.

Further, FIG. 6(*a*) is a perspective view showing the connectors according to the embodiment of the present invention, which are in the completely fitted state. FIG. 6(*b*) is a cross-sectional view corresponding to FIG. 6(*a*). FIG. 7 is a cross-sectional view showing relations between the lock portions and the arm portions when the connectors according to the embodiment of the present invention are in the completely fitted state. FIG. 8 is a side view showing a position of a deformation blocking part when the connectors according to the embodiment of the present invention are in the completely fitted state.

When the second connector 21 is fitted to the first connector 11, the rotating shaft pins 34 of the lever 31 are first inserted into the rotating shaft holes 16 in the frame 13. Thus, the lever 31 is rotatably attached to the first connector 11 (the frame 13) (see FIG. 3 and FIG. 4, for example).

After the lever 31 is attached to the first connector 11, the second connector 21 is slightly fitted into the frame 13 while holding the lever 31 at an initial position (such as a position shown in FIG. 1). Thus, the cam followers 22 are inserted into the cam grooves 35.

When the operating portion 38 of the lever 31 is subjected to the turning operation with the cam followers 22 inserted in the cam grooves 35, the distance between each cam follower 22 and the corresponding rotating shaft pin 34 becomes shorter and the second connector 21 is drawn into the first connector 11.

Then, after the lever 31 is turned to the position to bring the first connector 11 and the second connector 21 into the incompletely fitted state (the position of the lever 31 shown in FIG. 3 to FIG. 5), the connectors 11 and 21 are fitted into the attachment hole 52 in the panel 51 as shown in FIG. 3(*a*) and FIG. 3(*b*).

Here, when the lever 31 is situated in the turning position to bring the first connector 11 and the second connector 21 into the incompletely fitted state (the position of the lever 31 shown in FIG. 3 to FIG. 5), each of the deformation allowing parts 37 is located on the inner surface side of the corresponding lock portion 14 (for example, the side in the arrow Y direction in FIG. 4) as shown in FIG. 4 and FIG. 5.

For this reason, as shown in FIG. 4 and FIG. 5, the lock contact parts 18 of the lock portions 14 are out of contact with arm portions 32 of the lever 31. Thus, the deformation allowing parts 37 allow the flexural deformation of the lock portions 14.

Moreover, since the flexural deformation of the lock portions 14 is allowed, when the first connector 11 and the second connector 21 are fitted into the attachment hole 52 in the panel 51, each of the lock portions 14 is flexurally deformed toward the inner surface side of the first connector 11 (for example, the side in the arrow Y direction in FIG. 4) by a force to press the connectors 11 and 21 toward the front face side of the panel 51 (the side in the arrow Z direction in FIG. 1 and FIG. 4), and is thereby inserted through the attachment hole 52 (see FIG. 4).

After the lock portions 14 are inserted through the attachment hole 52, each of the flexurally deformed lock portions 14 restores its original form, and the lock projecting parts 17 come into contact with the panel 51 from the rear surface side 54 (see FIG. 4). In addition, when the lock portions 14 are inserted through the attachment hole 52, the panel contact part 39 of the lever 31 comes into contact with the hole edge 53 as shown in FIG. 3(*b*).

Then, while the panel contact part 39 is in contact with the hole edge 53, the lever-type connector 1 is pressed toward the front face side of the panel 51 (the side in the arrow Z direction in FIG. 1 and FIG. 4(*a*)). Thus, the panel contact part 39 is pressed against the hole edge 53.

When the panel contact part 39 is pressed against the hole edge 53, the lever 31 is turned from the position to bring the first connector 11 and the second connector 21 into the incompletely fitted state (the position shown in FIG. 3 to FIG. 5) to the position to bring the connectors 11 and 21 into the completely fitted state (the position shown in FIG. 6 to FIG. 8). Thus, the first connector 11 and the second connector 21 are fitted to the attachment hole 52 in the panel 51 (see FIG. 6(*a*) and FIG. 6(*b*)).

When the first connector 11 and the second connector 21 are brought into the completely fitted state, the female terminal tags (not shown) of the first connector 11 are connected to the male terminal tags (not shown) of the second connector 21 to achieve conduction.

Here, when the lever 31 is situated in the turning position to bring the first connector 11 and the second connector 21 into the completely fitted state (the position of the lever 31 shown in FIG. 6 to FIG. 8), each of the deformation blocking parts 36 is located on the inner surface side of the corresponding lock portion 14 (for example, the side in the arrow Y direction in FIG. 4 to be described later) as shown in FIG. 7 and FIG. 8.

For this reason, as shown in FIG. 7 and FIG. 8, the lock contact parts 18 of the lock portions 14 come into contact with the deformation blocking parts 36. Thus, the deformation blocking parts 36 block the flexural deformation of the lock portions 14.

As described above, when the lever 31 is situated in the turning position (the position of the lever 31 shown in FIG. 6 to FIG. 8) to bring the first connector 11 and the second connector 21 into the completely fitted state, the flexural deformation of the lock portions 14 is blocked by the deformation blocking parts 36, and the lock portions 14 cannot be inserted through the attachment hole 52.

For this reason, the lock portions 14 are not flexurally deformed even when an external force is applied to the lock portions 14 after the first connector 11 and the second connector 21 are attached to the attachment hole 52 in the panel 51. Thus, it is possible to prevent the connectors 11 and 21 from coming off the attachment hole 52.

When the first connector 11 and the second connector 21 are brought into the completely fitted state, the flange portion 15 comes into contact with the hole edge 53 from the front face side (the side in the arrow Z direction in FIG. 1 and FIG. 4) of the panel 51. Thus, the first connector 11 and the second connector 21 are fixed to the attachment hole 52 in the panel 51 (see FIG. 6(*b*)).

Thus, the deformation allowing parts 37 are located on the inner surface sides of the lock portions 14 when the connectors 11 and 21 are in the completely fitted state. Accordingly, the flexural deformation of the lock portions 14 is allowed and the connectors 11 and 21 can be attached to the attachment hole 52 in the panel 51.

In the meantime, when the connectors 11 and 21 are brought into the completely fitted state by pressing the panel contact part 39 against the hole edge 53 while keeping the panel contact part 39 in contact with the hole edge 53, the deformation blocking parts 36 are located on the inner surface sides of the lock portions 14. Accordingly, the flexural deformation of the lock portions 14 is blocked and the completely fitted connectors 11 and 21 can be prevented from coming off the attachment hole 52 in the panel 51.

Meanwhile, the lever 31 is turned to the turning position to bring the connectors 11 and 21 into the completely fitted state by pressing the panel contact part 39 against the hole edge 53 while keeping the panel contact part 39 in contact with the hole edge 53. Accordingly, the connectors 11 and 21 in the incompletely fitted state can be reliably prevented from being attached to the panel 51.

As described above, the lever-type connector 1 according to the embodiment of the present invention includes: the first connector 11; the second connector 21 fittable to the first connector; and the lever 31 provided on any one of the first connector 11 and the second connector 21, and configured to be turned to fit the first connector 11 and the second connector 21 to each other. The first connector 11 and the second connector 21 in the fitted state are attached to the attachment hole 52 in the panel 51. The one connector 11 includes the lock portions 14 which are flexurally deformed toward the inner surface sides and inserted through the attachment hole 52 when the connectors are attached to the attachment hole 52. The lever 31 includes: the arm portions 32 located on the inner surface sides of the one connector 11 when the lever 31 is turned; and the panel contact part 39 which turns the lever 31 by coming into contact with the hole edge 53 of the attachment hole 52 in the state where the lock portions 14 are inserted through the attachment hole 52. Each arm portion 32 includes: the deformation allowing part 37 allowing the flexural deformation by being located on the inner surface side of the corresponding lock portion 14 when the lever 31 is situated in the turning position to bring the first connector 11 and the second connector 21 into the incompletely fitted state, thereby allowing the flexural deformation; and the deformation blocking part 36 blocking the flexural deformation by being located on the inner surface side of the corresponding lock portion 14 when the lever 31 is situated in the turning position to bring the first connector 11 and the second connector 21 into the completely fitted state. The lever 31 is turned to the turning position to bring the first connector 11 and the second connector 21 into the completely fitted state by pressing the panel contact part 39 against the hole edge 53 while keeping the panel contact part 39 in contact with the hole edge 53.

Moreover, in the lever-type connector 1 according to the embodiment of the present invention, each deformation allowing part 37 is formed from the recessed groove portion provided in the surface of the arm portion 32, while each deformation blocking part 36 is formed from the surface of the arm portion 32 excluding the recessed groove portion.

In addition, in the lever-type connector 1 according to the embodiment of the present invention, the lever 31 further includes the operating portion 38 configured to perform the turning operation of the lever 31. Here, the lever 31 is turned by the turning operation of the operating portion 38 or by pressing the panel contact part 39 against the hole edge 53 while keeping the panel contact part 39 in contact with the hole edge 53.

Furthermore, according to the lever-type connector 1 of the embodiment of the present invention, when the connectors 11 and 21 are in the incompletely fitted state, the deformation allowing part 37 is located on the inner surface side of the corresponding lock portion 14. As a consequence, the flexural deformation of the lock portion 14 is allowed, whereby the connectors 11 and 21 can be attached to the attachment hole 52 in the panel 51.

In the meantime, when the connectors 11 and 21 are brought into the completely fitted state by pressing the panel contact part 39 against the edge hole 53 while keeping the panel contact part 39 in contact with the hole edge 53, the deformation blocking part 36 is located on the inner surface side of the lock portion 14. Accordingly, the lock portion 14 is inhibited from the flexural deformation, and the completely fitted connectors 11 and 21 can be prevented from coming off the attachment hole 52 in the panel 51.

In addition, the lever 31 is turned to the turning position to bring the connectors 11 and 21 into the completely fitted state by pressing the panel contact part 39 against the hole edge 53 while keeping the panel contact part 39 in contact with the hole edge 53. Accordingly, the connectors 11 and 21 in the incompletely fitted state can be reliably prevented from being attached to the panel 51.

Thus, it is possible to provide the lever-type connector 1 capable of preventing the connectors 11 and 21 in the incompletely fitted state from being attached to the panel 51, and preventing the connectors 11 and 21 from coming off the panel 51.

Moreover, in the lever-type connector 1 according to the embodiment of the present invention, the deformation allowing part 37 is formed from the recessed groove provided in the surface of the arm portion 32, while the deformation blocking part 36 is formed from the surface of the arm portion 32 excluding the recessed groove. As a consequence, the flexural deformation of the lock portion 14 can be blocked or allowed by using the simple structures.

Furthermore, in the lever-type connector 1 of the embodiment of the present invention, it is possible to establish the completely fitted state of the connectors 11 and 21 by: bringing the connectors 11 and 21 into the incompletely fitted state by using the operating portion 38; and then pressing the panel contact part 39 against the hole edge 53 while keeping the panel contact part 39 in contact with the hole edge 53. Hence, the fitting operation of the connectors 11 and 21 can be achieved easily.

The lever-type connector according to the embodiment of the present invention has been described above on the basis of the illustrated embodiment. It is to be noted, however, that the present invention is not limited only to the above-described embodiment. The configurations of the components therein may be replaced with other arbitrary configurations having similar functions thereto.

For example, the foregoing descriptions have been provided for the embodiment in which the lock portions 14 are provided at the four positions on the frame 13. However, the number of the lock portions 14 can be changed as appropriate.

In such a case, at least one of the lock portions 14 is to be disposed in such a position to locate the deformation allowing part 37 on the inner surface side of the lock portion 14 when the connectors 11 and 21 are in the incompletely fitted state and to locate the deformation blocking part 36 on the inner surface side when the connectors 11 and 21 are in the completely fitted mode. Thus, it is possible to achieve the same operation and effects as those of the lever-type connector according to the above-described embodiment of the present invention.

INDUSTRIAL APPLICABILITY

The present invention is extremely useful for preventing incompletely fitted connectors of a lever-type connector from being attached to a panel, and for preventing the connectors of the lever-type connector from coming off the panel.

The invention claimed is:

1. A lever-type connector comprising:

a first connector;

a second connector fittable to the first connector; and a lever provided on any one of the first connector and the second connector, and configured to be turned to fit the first connector and the second connector to each other, wherein the first connector and the second connector in a fitted state are attached to an attachment hole in a panel, the one connector includes a lock portion designed to be flexurally deformed toward its inner surface side and inserted through the attachment hole in the course of attaching the connectors to the attachment hole, the lever includes an arm portion located on the inner surface side of the one connector while the lever is being turned, and a panel contact part configured to turn the lever by coming into contact with a hole edge of the attachment hole in a state where the lock portion is inserted through the attachment hole, the arm portion includes a deformation allowing part designed to allow flexural deformation of the lock portion by being located on an inner surface side of the lock portion when the lever is situated in a turning position to bring the first connector and the second connector into an incompletely fitted state; and a deformation blocking part designed to block the flexural deformation of the lock portion by being located on the inner surface side of the lock portion when the lever is situated in a turning position to bring the first connector and the second connector into a completely fitted state, and the lever is turned to the turning position to bring the first connector and the second connector into the completely fitted state, by pressing the panel contact part against the hole edge while keeping the panel contact part in contact with the hole edge.

2. The lever-type connector according to claim 1, wherein the deformation allowing part comprises a recessed groove portion provided in a surface of the arm portion, and the deformation blocking part comprises the surface of the arm portion excluding the recessed groove portion.

3. The lever-type connector according to claim 1, wherein the lever further comprises an operating portion configured to perform a turning operation of the lever, and the lever is turned by the turning operation of the operating portion, or by pressing the panel contact part against the hole edge while keeping the panel contact part in contact with the hole edge.

4. The lever-type connector according to claim 2, wherein the lever further comprises an operating portion configured to perform a turning operation of the lever, and the lever is turned by the turning operation of the operating portion, or by pressing the panel contact part against the hole edge while keeping the panel contact part in contact with the hole edge.

* * * * *